United States Patent [19]

Rochelt

[11] 4,312,126

[45] Jan. 26, 1982

[54] RECIPROCALLY DRIVING MEANS

[75] Inventor: Günter Rochelt, München-Solln, Fed. Rep. of Germany

[73] Assignee: Matsushita Electric Works, Ltd., Osaka, Japan

[21] Appl. No.: 131,184

[22] Filed: Mar. 17, 1980

[30] Foreign Application Priority Data

Mar. 16, 1979 [DE] Fed. Rep. of Germany ..... 2910469

[51] Int. Cl.[3] ..... B26B 19/02

[52] U.S. Cl. ..... 30/43.92; 74/49

[58] Field of Search ..... 30/43.91, 43.92, 42, 30/216, 219; 74/45, 47, 49

[56] References Cited

U.S. PATENT DOCUMENTS

| | | | |
|---|---|---|---|
| 4,065,977 | 1/1978 | Buzzi | 30/43.92 X |
| 4,167,060 | 9/1979 | Sakamoto | 30/43.92 |

FOREIGN PATENT DOCUMENTS

| | | | |
|---|---|---|---|
| 2749936 | 5/1978 | Fed. Rep. of Germany | 30/43.92 |
| 54-6180 | 1/1979 | Japan | 30/43.92 |
| 54-123360 | 9/1979 | Japan | 30/43.92 |
| 825518 | 12/1959 | United Kingdom | 30/43.92 |

*Primary Examiner*—Nicholas P. Godici

*Attorney, Agent, or Firm*—Burns, Doane, Swecker & Mathis

[57] ABSTRACT

The invention relates to a reciprocating driving device for a movable member such as a movable hair shearing blade assembly in reciprocal type electrical shaver. A reciprocally driven mounting member is coupled to an eccentric shaft of a motor and comprises a carrier which carries the movable blade. Resilient legs support the plate part for movement only in the direction of reciprocation and are fixed at the other end. Each leg includes at least two parts joined intermediate their ends by a rigid member disposed parallel to the carrier. A driven arm extends from the carrier to flex only in directions perpendicular to the direction of reciprocation.

13 Claims, 14 Drawing Figures

RECIPROCALLY DRIVING MEANS

This invention relates generally to a reciprocating drive assembly for a movable member such as a movable blade of electric shavers or clippers or the like hair cutting devices and, more particularly, to improvements in an element interposed for achieving the reciprocal driving between a rotary driving power source and the movable blade to transmit a motion of the source to the movable member as a pure linear reciprocal motion.

Attention is directed to an arrangement shown in the U.S. Pat. No. 3,105,298 as an example of conventional reciprocally driving means of the kind referred to by reference to FIG. 14, herein. Disclosed therein is a reciprocally driving element for a movable blade assembly which shears hair in cooperation with an outer stationary blade of an electric shaver. The driving element comprises a member for mounting thereon the movable blade assembly and provided with (i) a mounting part to which the assembly is mounted, (ii) a coupling part to be coupled operatively to a rotary driving source, and (iii) a pair of resilient leg parts supporting the mounting member rockably on a fixing base within shaver body. More specifically, the mounting member 100 of an elongated shape for the movable blade assembly 101 has (i) a central projection 102 to which the assembly 101 is engaged on the upper surface of the member 100 and (ii) a central slot 103 made as the coupling part in the lower surface of the member 100 so as to intersect with its longitudinal axis the longitudinal direction of the member 100 at right angles. This slot 103 receives slidably a tip end of an eccentric rotary shaft 104 of the rotary driving source. Therefore, components of rotary motions of the eccentric shaft 104 are transmitted to the member 100 only in the direction intersecting at right angles the longitudinal axis of the slot 103, that is, in the longitudinal direction of the member 100 (to the left and right in FIG. 14), so as to reciprocally drive the movable blade assembly 101 only in the longitudinal direction of the member 100. The resilient leg parts 105 formed integral with the mounting member 100 are suspended respectively from each of both longitudinal ends of the mounting member and are fixed at their extended ends to the fixing base. The respective resilient leg parts 105 are made in a thin and flat plate shape and are so suspended from the member 100 that their thickness direction coincides with the reciprocating direction of the member so as to resiliently flex only in the desired reciprocating direction of the mounting member 100.

Now, in manufacturing such reciprocally driving element as above of the conventional example, it will, in practice, be very difficult to achieve a uniform thickness in the respective leg parts as well as equal thickness and width for the both leg parts which are formed integral with the mounting member so that both will have the same elastic coefficient. In an event when the elastic coefficients of the both resilient leg parts are not identical with each other, the flexures of the respective leg parts will not be identical with each other during the reciprocal movements of the driving element. This results in that the heights of the respective flexed leg parts are not identical with each other. Accordingly, motion components of the ends of the reciprocating mounting member 100 caused by the flexing of the leg parts in directions perpendicular to the plane of the member are non-uniform so as not to be parallel to the plane of the stationary blade, whereby the reciprocally driving element will inevitably include very inclined surges at both longitudinal ends. That is, the mounting member tends not to travel parallel to the stationary blade, so the pressure of the blades against each other varies along their common interfaces.

When the reciprocating motion includes such surges in the electric shaver of the type shown, contact pressure of respective blades of the movable blade assembly with the outer stationary blade will periodically fluctuate at certain position or positions of the reciprocating motion of the movable blade assembly. Even in case this surging motion is very slight, the fluctuation of the contact pressure will elevate the friction between the stationary and movable blades and, as a result, energy consumption and blade wear will increase. Since this surging motion will increase with increases of reciprocating amplitude of the movable blade assembly, the particular motion will inherently accompany a problem that hair has to be shaved at such a short amplitude that the surging motion will not be noticeable. In the case of the electric hair clipper, this surging motion appears as a slightly arcuate motion of a comb-shaped movable blade on its plane of sliding along a contacting surface of an also comb-shaped stationary blade so that a possible reduction of shearing performance does not matter so much since the surfacial contacting slide is not influenced by the surging motion. In the case of the reciprocal type electric shaver, however, specifically when beard hair is shaved deeply by strongly pressing the outer stationary blade of the shaver against the user's skin to introduce hair to the root into hair inlet holes, excess outward and inward flexures as well as recovery motions from the excess flexures of the resilient legs repeated in response to up-and-down motions of the outer blade due to such strong pressing will result in undesirable fluctuations in the contact pressure between the movable blades and the outer stationary blade. Thus, there have been caused such defects that the friction between the stationary and movable blades is elevated, the energy consumption is unduly increased, and the blades are quickly worn out. Further, as the length of the resilient leg parts is generally determined by the distance between the movable blade mounting member and the fixing base for the member the length will be restricted to be relatively short. Therefore, there are defects that, even in case the reciprocating amplitude of the mounting member is small, the flexure of such short resilient leg parts has to be made comparatively large whereby (i) the leg parts will break easily due to quick fatigue, (ii) driving load imposed on the movable blade mounting member will be high, (iii) the electric power consumption will be high and (iv) the reciprocating motion cannot be made stable and smooth for long. Further, as the flexure of the resilient leg parts with their extended fixed ends as a fulcrum results in variations of the height of the mounting member with respect to the fixing base or fixing points of the leg parts, the mounting member performs parallel shiftings transversely of the direction of reciprocation with respect to the fixing points during the reciprocating motion, so long as the respective leg parts equally flex. Such parallel shiftings of the mounting member cause the fluctuations to occur in the contact pressure between the movable blades and the outer stationary blade, and an additional means for resiliently absorbing the parallel shifting of the mounting member must be employed generally between the member and the movable blade assembly. It is difficult in practice, however, to perfectly avoid the contact pressure fluctuation over the entire amplitude of the reciprocating driving even by such absorbing means, so that the problems will still remain in the shearing performance reduction, the friction rise, the increased energy consumption and the quick wear of the blades. Accordingly, it has been necessary to have the reciprocating driving of the movable blade assembly performed at the smallest possible amplitude so that the parallel shifting and its resultant defects will be negligibly small. The present invention has been suggested to remedy such defects of the conventional reciprocal driving means.

A primary object of the present invention is, therefore, to provide a reciprocally driving means wherein the element for carrying the movable blade assembly and reciprocally driving same is prevented from causing the surging motion of the movable blade assembly as well to prevent the excess flexures of the resilient leg parts, whereby the fluctuation in the contact pressure of the movable blades of the assembly with the outer stationary blade is effectively prevented.

Another object of the present invention is to provide a reciprocally driving means wherein the resilient leg parts of the reciprocally driving element can be made longer even within a limited space so that the driving load imposed on the element for mounting and reciprocally driving the movable blade assembly can be reduced while the element can be minimized in size.

Still another object of the present invention is to provide a reciprocally driving means wherein any undesirable shifting of the reciprocally driving element which results in the contact pressure fluctuation during its reciprocal motion can be effectively prevented.

Other objects and advantages of the present invention shall be made clear upon reading the following disclosure detailed with reference to preferred embodiments of the invention shown in accompanying drawings, in which.

Figure 10:
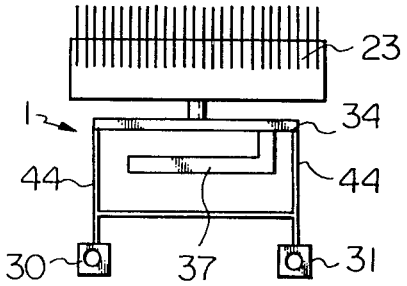
FIG. 10 is a schematic front elevation of a further embodiment of the element according to the present invention with a movable blade assembly mounted to the element.
Figure 11:
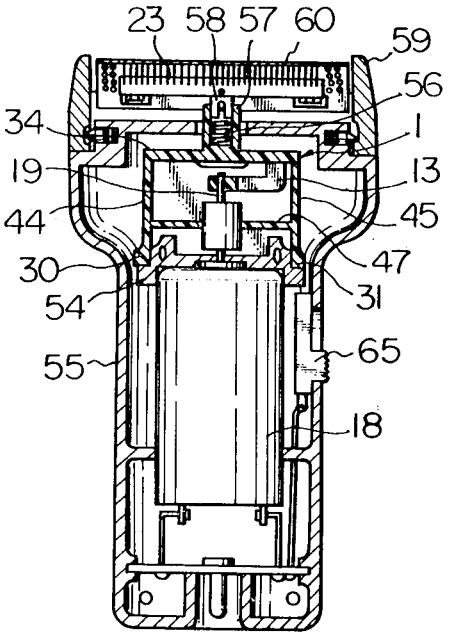
Figure 12:
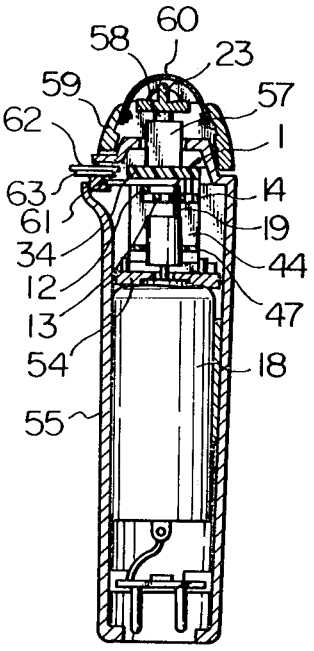
Figure 13:
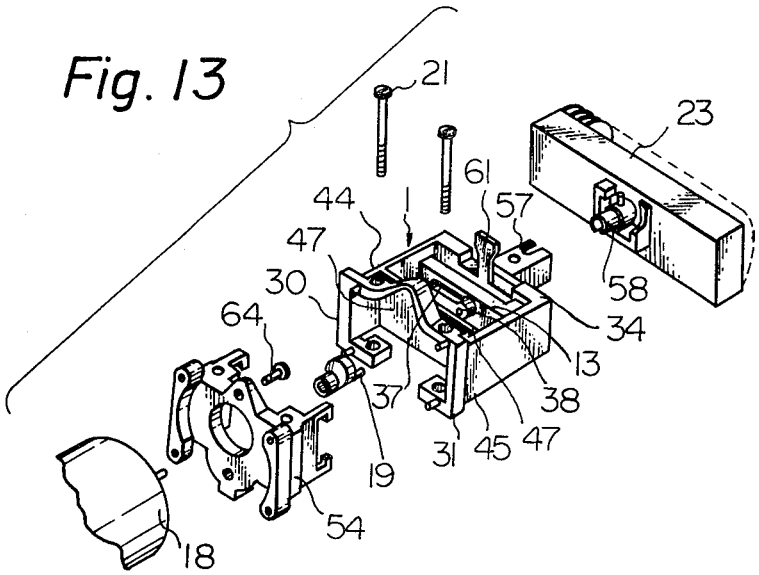
Figure 14:
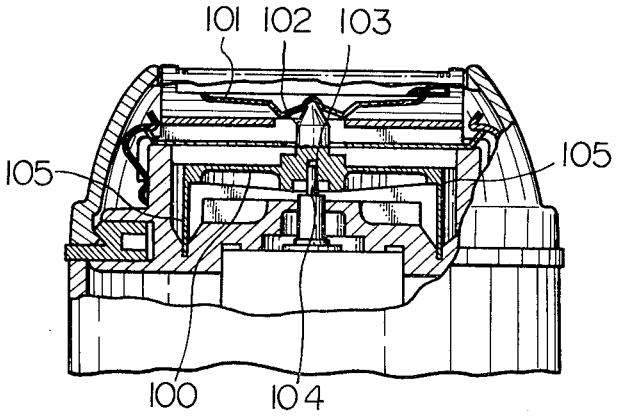
Fig. 14 PRIOR ART

FIGS. 11 through 13 show the embodiment of FIG. 10 as assembled practically in a reciprocal type electric shaver, respectively in a longitudinally vertically sectioned view and crosswise vertically sectioned view of the entire shaver, and in a perspective view of main parts of the shaver as disassembled; and FIG. 14 is a fragmentary front view of an electric shaver with its main parts in section for showing an exemplary structure of conventional reciprocal driving means.

Figure 1:
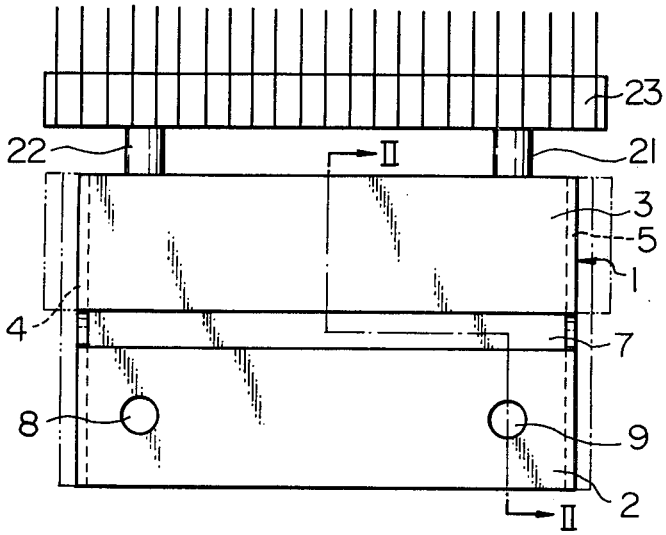
FIG. 1 is a front elevation of an embodiment of the reciprocally driving element according to the present invention, with a movable blade assembly shown schematically as mounted to the element.
Figure 2:
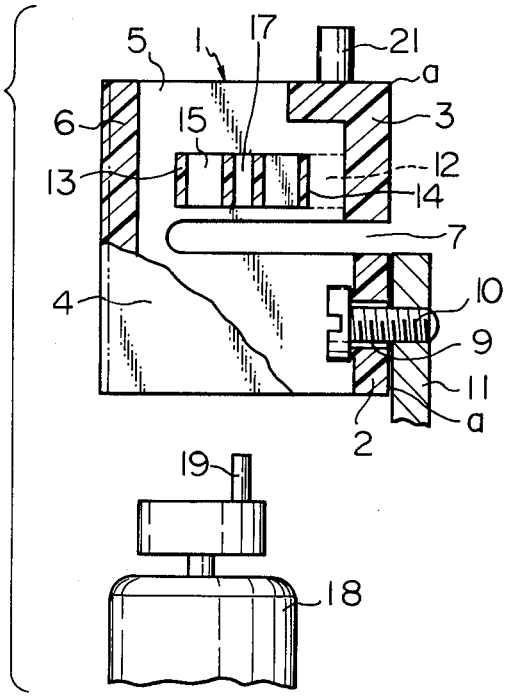
FIG. 2 is a partly sectioned view only of the element of FIG. 1 taken on line II—II, but with a rotary driving source shown fragmentarily as disassembled from the element.
Figure 3:
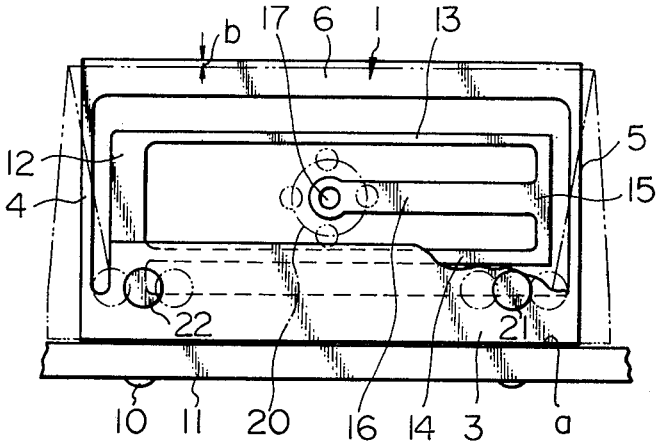
FIG. 3 is a plan view only of the element of FIG. 1 with a part removed.

Referring now to the embodiment shown in FIGS. 1 to 3, a reciprocally driving element or assembly 1 comprises a fixing part 2, movable blade mounting part or carrier portion 3 and resilient parts 4 and 5 connecting the parts 2 and 3 with each other. The respective fixing part 2 and movable blade mounting part 3 are substantially an elongated plate shape, which are arranged parallel to one another so as to define with their one surface a a common plane as separated from each other with a clearance 7. The resilient parts 4 and 5 each comprise a thin plate having a slit extending from an end edge to a position close to an opposing end edge dividing the plate into two resilient legs substantially of a U-shape. The legs are joined at their ends to each of both longitudinal ends of the respective fixing and mounting parts 2 and 3, so that the divided two legs of each of these resilient parts 4 and 5 will resiliently couple the separated parallel parts 2 and 3 at their adjacent ones of the both longitudinal ends. The opposing end edges of the resilient parts 4 and 5 remote from the parts 2 and 3 are connected to each other by a connecting plate part 6 which is arranged parallel to the fixing and mounting parts 2 and 3. Since the divided two legs of the resilient parts 4 and 5 are made of wide and thin elastic plates, they are highly resilient in the direction of their thickness, that is, in the longitudinal directions of the fixing and mounting parts 2 and 3, but are not flexible in their expanding directions intersecting at right angles the longitudinal directions of the respective plate parts 2, 3 and 6. In this arrangement, the slits in the respective resilient parts 4 and 5 are aligned with the clearance 7. Accordingly, the reciprocal driving element 1 is formed substantially in a compact box shape of a rectangular parallelpipe which is opened above and below, that is, in the expanding directions of the resilient parts 4 and 5. The effective length of the turned-back resilient parts 4 and 5 over which these parts can flex is thus substantially double relative to the actual distance between the fixing part 2 or mounting part 3 and the connecting plate part 6, by means of the slit made in each of the resilient parts 4 and 5. The connecting part 6 is connected to the turned-back resilient legs 4, 5 intermediate their connections with the fixing part 2 and the mounting portion 3.

The fixing plate part 2 has through holes 8 and 9, and screws 10 are passed through these holes 8 and 9 and are screwed to a stationary part 11 of a shaver housing so as to fix the fixing part 2 to the housing. On the other hand, a resilient supporting arm or driven portion 12 is formed inside the element 1 to extend from the mounting part 3 at a position close to one of the divided legs of the resilient part 4 joined to the mounting part 3 and in parallel to the leg. Two strip-shaped outer bars 13 and 14 extending parallel to the mounting part 3 and connecting part 6 are joined at their one end to the supporting arm 12 and are connected with each other at the other end by means of a shaft bearing arm 15. A central bar 16 also extending parallel to the outer bars 13 and 14 projects from the middle of the bearing arm 15 while. A shaft bearing hole 17 is formed at the extended free end of the central bar 16. It is preferable to form these arms 12 and 15 and bars 13, 14 and 16 integrally with the fixing part 2, mounting part 3, resilient parts 4 and 5 and connecting part 6, as a molding of synthetic resin. An eccentric shaft 19 of a driving motor 18 which is a rotary driving source is fitted in the shaft bearing hole 17. The distance from the supporting arm 12 through the outer bars 13, 14 and bearing arm 15 to the central bar 16 is made so large that the free end of the central bar 16 moving on an eccentric circle 20 represented by a chain line in FIG. 3 does not contact the outer bars 13 and 14 even in the extreme operating positions. Driving bushes 21 and 22 are provided on the mounting part 3 to project in the direction parallel to the plane a for mounting thereon a movable blade assembly 24 having a plurality of semicircular cutting edges in a manner slidable in the projected direction of the bushes.

Figure 4:
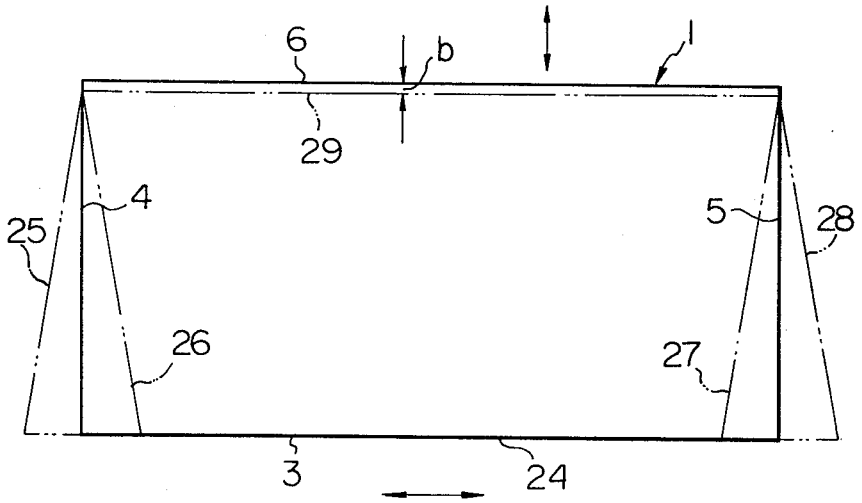
FIG. 4 is a schematic plan view of the element of FIG. 1 for explaining its reciprocally moving mode.

With the above arrangement of the reciprocal driving element 1, the mounting part 3 is operated to vibrate reciprocally in its longitudinal direction as shown by chain lines in FIG. 1 or 3 with a larger amplitude than the connecting part 6. In FIG. 4, there is shown in a magnified scale a geometric relation between the parts 3 and 6, in which the front face of the mounting plate part 3 vibrates linearly in parallel to the fixing part 2 and in the common plane a which is shown by a reference 24 in the drawing. In the extreme rightward operated position of the mounting piece 3, the respective legs of the resilient part 4 divided by the slit will be in positions substantially of a V-shape as shown by chain lines 25 and 26 and, at this time, the respective legs of the other resilient part 5 will be in positions also substantially of V-shape as represented by chain lines 27 and 28. That is, the lines 25 and 26 represent the upper and lower parts of the leg 4 (i.e., the parts separated by the clearance 7) and demonstrate that those parts are not coplanar in the condition depicted. Rather, the leg has flexed such that those parts form a "V" as viewed in plan. A similar relationship exists in connection with the leg 5 whose upper and lower parts are designated by lines 27, 28. In the extreme leftward position of the mounting part 3, the respective legs of the resilient parts 4 and 5 will exchange their positions in the same manner and, in the respective extreme positions of the mounting part 3, the connecting plate part 6 will be shifted from its position represented by a solid line to that shown by a chain line 29. The parallel shiftings of the connecting plate part 6 through a stroke b (i.e., a shifting transversely of the direction of reciprocation) are caused, however, in the direction toward the mounting part 3 carrying the movable blade assemble which itself vibrates simply along the plane a. Thus, the work of the connecting part 6 is not only to absorb any shifting of the mounting part 3 transverse to the reciprocation direction but also to interfere with the respective resilient legs 4 and 5 in case they are different from each other in the thickness or width so as to be nonuniform in the elastic coefficient, so that any surging motion of the movable blade mounting part 3 due to independent nonuniform flexing of the resilient legs 4 and 5 will be prevented effectively and vibrating motion of the reciprocally driving element 1 can be well stabilized.

When the eccentric shaft 19 is rotatably driven by the motor 18 while inserted in the hole 17 in the central bar 16 of the reciprocal driving element 1, the free end of the central bar 16 makes circular motions. The motion components in such circular motion acting in the directions perpendicular to the longitudinal directions of the bar 16 will be absorbed by the flexions of the central bar 16 as well as those of the outer bars 13 and 14 so as not to be transmitted to the movable blade mounting part 3. The motion components acting in the longitudinal directions of the central bar 16 as well as the outer bars 13 and 14 will be transmitted to the mounting part 3, so that the resilient legs 4 and 5 will be flexed and the mounting part 3 will be driven to reciprocate as referred to.

Figure 5:
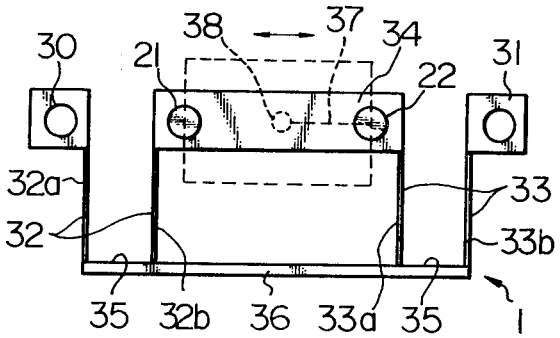
FIGS. 5 through 9 are respectively a schematic plan view of other embodiment of the element according to the present invention.

Referring next to another embodiment shown in FIG. 5, a pair of resilient legs 32 and 33 respectively extending from each of two divided fixing parts 30 and 31 are turned back to each longitudinal end of a movable blade mounting part 34 disposed longitudinally between the fixing parts 30 and 31 so that the resiliency of the resilient legs is, in effect, increased. The resilient legs 32 and 33 are connected with each other through a connecting part 36 disposed between extended ends of the respective legs. The movable blade mounting part 34 is longitudinally vibrated by circular motions of the eccentric shaft fitted in a bearing hole 38 formed in a resilient shaft bearing bar 37 shown by dotted lines as extended from the mounting part 30 in parallel thereto. The deforming load of the resilient legs 32 and 33 is so low that the movable blade mounting part 34 can be driven to reciprocate with a low load. In this embodiment, the resilient legs 32 and 33 extending from the fixing parts 30 and 31 are turned back to the side of the movable blade mounting part 34 and the fixing pieces 30 and 31 are aligned with the mounting part 34. Therefore, in case the mounting part 34 moves in its longitudinal direction indicated by arrows, respective portions **32*a* and 32*b* of the resilient leg 32 will be equal to each other in the resistance moment and will flex by the same amount. Because of this flexing, the extended height of the portion 32*a* from the part 30 will be reduced but this reduction will be equal to a similarly occurring reduction of the extended height of the portion 32*b* and, therefore, a turned portion 35 will reciprocate. Also, in the resilient leg 33, portions 33*a* and 33*b* will be equal to each other in the reduction of the extended height, so that when the turned portion 35 reciprocates the movable blade mounting part 34 will linearly reciprocate in its longitudinal direction. The portions 32*a* and 32*b* of the resilient leg 32 are formed as beams of an equal strength so that stresses may be substantially equal over the total height or length and, therefore, the maximum stress within the leg portions can be minimized. In case the leg is made of a synthetic resin, the maximum stress within the leg portions can be minimized by varying the cross-sectional area over the total height or length of the leg portions or varying the thickness and width. In the same manner as in the above described first embodiment, the connecting part 36 will interfere with the resilient legs 32 and 33 and will prevent any surging motion of the movable blade mounting part 34 caused by independent nonuniform flexing of the resilient legs 32 and 33 and, therefore, the motion of the reciprocally driving element 1** will become more stable.

Figure 6:
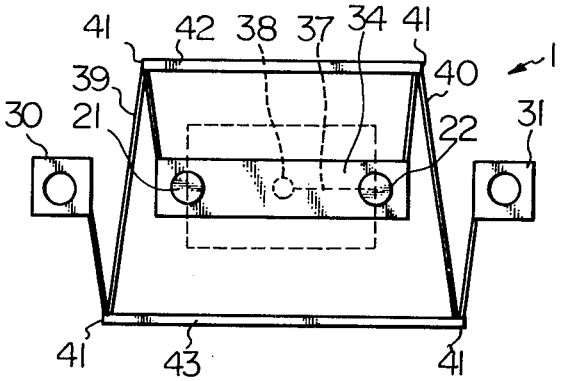

FIG. 6 shows another embodiment wherein the movable blade mounting piece 34 positioned substantially as aligned with the two fixing parts 30 and 31 is connected with them through respective resilient legs 39 and 40. The legs extend respectively in one lateral direction from the fixing pieces 30 and 31 and are turned back in the other lateral direction and again back to the respective longitudinal ends of the mounting part 34 so that the resiliency of the resilient legs 39 and 40 is maximized. The two turned portions 41 of the resilient legs 39 and 40 are connected with each other respectively through connecting parts 42 and 43. In the same manner as in the above referred second embodiment, the shiftings transverse to the direction of reciprocation occur only in the connecting parts 42 and 43, so that any surging motion of the movable blade mounting part 34 can be prevented and the motion of the reciprocally driving element 1 can be more stable.

Figure 7:
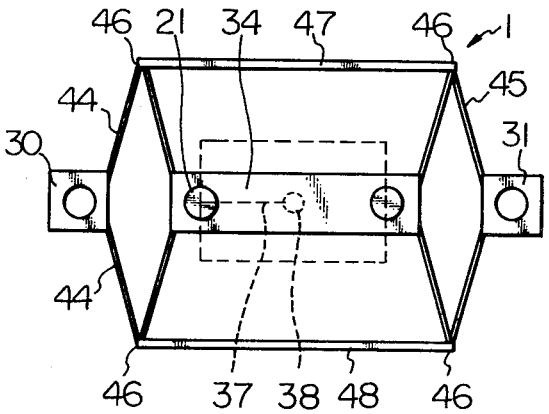

FIG. 7 shows a further embodiment, wherein the movable blade mounting part 34 positioned between the two divided and aligned fixing parts 30 and 31 is connected to the latter at their respective longitudinal ends by a pair of resilient legs 44 or 45. The legs are V-shaped and disposed on each lateral side symmetrically, so that their resiliency is maximized. Respective turned portions 46 of the resilient legs 44 and 45 on both lateral sides are connected with each other respectively through connecting parts 47 and 48. In the same manner as in the above referred second or third embodiment, the shiftings transverse to the direction of reciprocation take place only in the connecting parts 47 and 48 so that any surging motion of the movable blade mounting piece 34 can be prevented and the motion of the reciprocally driving element 1 can be more stabilized.

Figure 8:
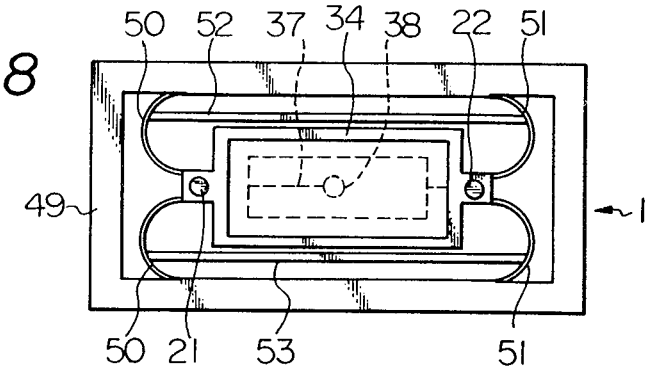

FIG. 8 shows a further embodiment, wherein the movable blade mounting part 34 is formed in a rectangular frame shape, which is supported within a fixing part 49 of a larger rectangular frame shape by two pairs of resilient legs 50 and 51. The legs are curved to be semicircular, each pair of legs bridging respective longitudinal ends of the mounting part 34 at lateral sides of the larger fixing frame 49 symmetrically, so that the resiliency of the resilient legs 50 and 51 is maximized. The resilient legs 50 and 51 are connected with each other respectively through connecting bars 52 and 53. In the same manner as in the foregoing embodiments, the shiftings transverse to the direction of reciprocation will take place only in the connecting bars 52 and 53, whereby any surging motion of the movable blade mounting piece 34 can be prevented and the motion of the reciprocally driving element 1 can be well stabilized.

Figure 9:
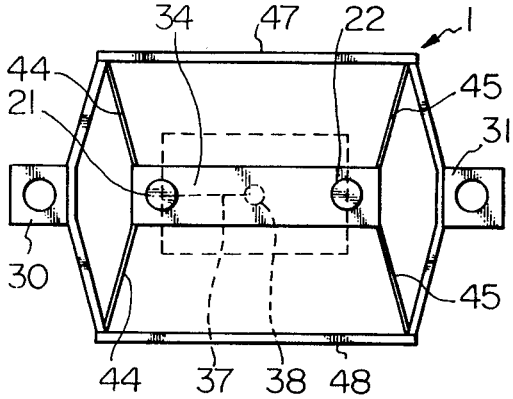

FIG. 9 shows a still further embodiment, wherein one of the resilient legs extending from the movable blade mounting part 34 or fixing parts 30 and 31 in the embodiment of FIG. 7 is made thicker so as to be lower in the resiliency than the other, and the resilient legs 44 and 45 are connected with each other respectively through connecting bars 47 and 48. In the same manner as in the foregoing embodiments, the shiftings transverse to the direction of reciprocation take place only in the connecting bars 47 and 48, whereby any surging motion of the movable blade mounting part 34 can be prevented and the motion of the reciprocally driving element 1 can be made stable.

In FIG. 10, there is shown a modification of the embodiment of FIG. 9, wherein end edges of the two adjacent resilient legs 44 and 45 (among the four resilient legs 44 and 45 extending from the movable blade mounting piece 34 in the embodiment of FIG. 9) constitute the fixing parts 30 and 31, and the respective resilient legs 44 and 45 are connected with each other through the connecting bar 47. In the same manner as in the foregoing embodiments, the surging motion of the movable blade mounting part 34 will be prevented and the motion of the reciprocally driving element 1 can be made stable.

The modified embodiment of FIG. 10 as incorporated in an electric shaver is shown in FIGS. 11 to 13, wherein 1 is the reciprocally driving element which is formed substantially in a U-shape. The element 1 comprises (i) the movable mounting part 34 for mounting the movable blade assembly 23 having a plurality of semicircular cutting edges and (ii) a pair of the resilient legs 44 and 45 suspended from both longitudinal ends of the movable blade mounting part 34. The fixing parts 30 and 31 respectively provided integrally with the resilient legs 44 and 45 at their lower end portion are fixed to a housing 55 of the electric shaver together with a motor base 54 on which the motor 18 is mounted. When the resilient legs 44 and 45 are connected with each other through the thin connecting piece 47, or the connecting piece 47 is borne by the resilient legs 44 and 45, the resilient legs 44 and 45 can be smoothly deformed without being obstructed by the connecting piece 47 and the load on them can be reduced. A driving bush 57 in which a coiled spring 56 is inserted is provided to project in the middle of the upper surface of the mounting part 34. The movable blade assembly 23 is mounted for up and down movement on the movable blade mounting piece 34 by inserting a connecting shaft 58 provided to project in the middle of the lower surface of the assembly 23 into the driving bush 57, so as to be in close contact at the cutting edges with the inner periphery of a flexible thin outer blade body 60 removably mounted on an outer blade frame 59. An auxiliary blade driving part 61 is provided to project at a proper place of the reciprocally driving element and driving bush 57 and is fitted to a movable blade 63 having comb-shaped cutting edges reciprocally sliding on a fixed blade 62 having comb-shaped cutting edges. Screws 64 fix the motor 18 to the motor base 54, and a switch 65 is provided for the motor.

The reciprocally driving means of the present invention thus comprises a driving source, a movable blade assembly, and a reciprocally driving element coupling the source to the assembly. The driving element comprises (i) a mounting part for mounting a movable blade or blade assembly and connected to a rotary driving part of a driving source, (ii) resilient legs extending from both end portions of the mounting part to vibratably support the movable blade mounting piece, (iii) a fixing part for fixing the resilient legs, and (iv) a connecting part for connecting the resilient legs with each other. As a result, the respective resilient legs will be flexed not independently by elastic coefficient but in their interfering relation with each other so that differences in their flexures will be canceled out in case the elastic coefficients are different between the resilient legs. Thus, no surging motion of the movable blade mounting part will be caused by a greater flexing of a resilient leg of a smaller resilient coefficient. The contact pressure of the movable blade with the fixed blade will be stable for the entire reciprocating motion of the movable blade assembly and, as a result, the energy consumption and the wear of the blades will be low.

What I claim as my invention is:

1. A reciprocatory drive assembly in a cutter of the type comprising a housing, opposing fixed and movable blade means in said housing, and a drive source for reciprocating said movable blade means relative to said fixed blade means, said reciprocatory drive assembly interconnecting said drive source and said movable blade means and comprising:

a mounting part including:

a carrier portion carrying said movable blade means and including a pair of opposite ends, and a driven portion connected to said drive source for reciprocation of said carrier portion, a fixing part anchored to said housing, a pair of resilient legs connecting said opposite ends of said carrier portion with said fixing part and arranged to be flexed in the direction of reciprocation of said movable blade means when the latter is reciprocated, and a connecting part oriented parallel to said direction of reciprocation and connecting said resilient legs to each other at a location on the latter between said fixing part and said carrier portion for restraining said mounting part to linear movement in said direction of reciprocation parallel to said fixed blade means.

2. A reciprocally driving means according to claim 1 wherein the driving part of said driving source is an eccentric shaft of the source.

3. A reciprocally driving means according to claim 1 wherein said carrier portion resilient legs extend from said fixing part and are turned back toward said and said fixing part is positioned in parallel to the carrier portion.

4. A reciprocally driving means according to claim 1 wherein said resilient legs extend from said fixing part and turned back toward said carrier portion, and said fixing part is positioned to be aligned with the carrier portion.

5. A reciprocally driving means according to claim 2 wherein turned portions of said resilient legs are connected with each other by said connecting part.

6. A reciprocally driving means according to claim 1 wherein said mounting part and fixing part are arranged in the same plane, and first and second plate-shaped resilient legs are suspended from both of the mounting and fixing parts and are connected to each other by said connecting part having surfaces opposed and parallel to the respective mounting and fixing parts.

7. A reciprocally driving means according to claim 1 wherein said fixing part comprises two divided parts arranged to be in alignment with each other in front and rear of said carrier portion, and each end of the mounting part and one end of the respective divided fixing parts are connected with each other by means of a turned resilient leg having a surface opposing each other.

8. A reciprocally driving means according to claim 7 wherein said resilient legs are turned substantially to be U-shaped in section.

9. A reciprocally driving means according to claim 7 wherein said resilient legs extend respectively in different directions from said carrier portion and fixing parts and are turned and bridged at respective turned ends.

10. A reciprocally driving means according to claim 7 wherein said resilient legs are substantially of V-shape and are so arranged that said V-shaped resilient legs are symmetrical with each other with respect to the line connecting said two divided fixing parts.

11. A reciprocally driving means according to claim 9 wherein one of said turned resilient legs is made lower in resiliency than the other.

12. A reciprocally driving means according to claim 2 wherein said driven portion comprises a resiliently flexible vibrating arm fixed to said carrier portion, and said eccentric shaft of said driving source is disposed in a bearing at a free end of said vibrating arm.

13. A reciprocally driving means according to claim 1 wherein said carrier portion, resilient legs, fixing part and connecting part are all integrally formed of a synthetic resin material.

* * * * *